United States Patent [19]

Armistead

[11] 4,190,995

[45] Mar. 4, 1980

[54] COMPOSITE BUILDING UNIT, METHOD OF PRODUCING SAME

[76] Inventor: John A. Armistead, 4516-15 Randolph Rd., Charlotte, N.C. 28211

[21] Appl. No.: 928,164

[22] Filed: Jul. 26, 1978

[51] Int. Cl.[2] ..... E04B 02/00

[52] U.S. Cl. ..... 52/309.9; 52/594

[58] Field of Search ..... 52/594, 612, 396, 593, 52/586, 309.12, 309.9; 46/25; 49/DIG. 1

[56] References Cited

U.S. PATENT DOCUMENTS

| | | | |
|---|---|---|---|
| 2,150,809 | 3/1939 | Rugg . | |
| 2,198,688 | 4/1940 | Williamson . | |
| 2,550,945 | 5/1951 | Steinhage . | |
| 2,868,008 | 1/1959 | Toulmin . | |
| 3,204,381 | 9/1965 | Perreton . | |
| 3,512,327 | 5/1970 | La Padura . | |
| 3,546,833 | 12/1970 | Perreton . | |
| 3,653,170 | 4/1972 | Sheckler | 52/309.12 |
| 3,885,363 | 5/1975 | Whittey . | |
| 3,916,503 | 11/1975 | Chenevert | 49/DIG. 1 |
| 3,950,202 | 4/1976 | Hodges . | |
| 3,982,369 | 9/1976 | Keleske . | |
| 3,984,957 | 10/1976 | Piazza . | |
| 4,016,693 | 4/1977 | Warren . | |
| 4,027,445 | 6/1977 | Nickerson . | |
| 4,055,928 | 11/1977 | Magerle . | |

*Primary Examiner*—John E. Murtagh

*Attorney, Agent, or Firm*—Richards, Shefte & Pinckney

[57] ABSTRACT

A composite building unit comprising a pair of spaced brick-like elements, each having a plurality of recesses in an inwardly facing side thereof, and an intermediate insulating element having a plurality of projections extending outwardly from each of two opposed side faces thereof, the brick-like elements and the intermediate element being joined by a press fit with the projections of the intermediate element being received within the recesses of the brick-like elements to frictionally hold the elements together. The intermediate element is formed with a raised barrier portion extending along the top thereof and with an indentation extending along the bottom thereof to receive the barrier portion of another composite unit when stacked in mortar joint wall construction, the barrier portion acting as a dam to prevent the passage of water through the mortar joints and to channel the water to the ends of the unit for drainage to successively lower courses of masonry.

13 Claims, 6 Drawing Figures

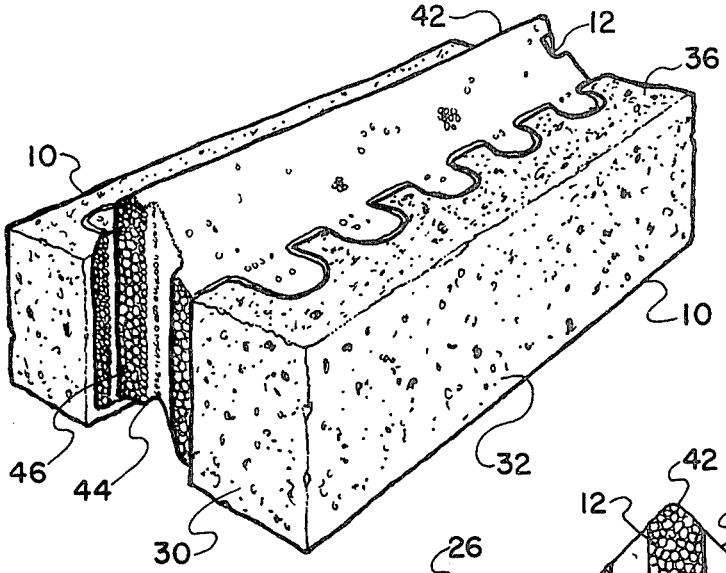
FIG.1
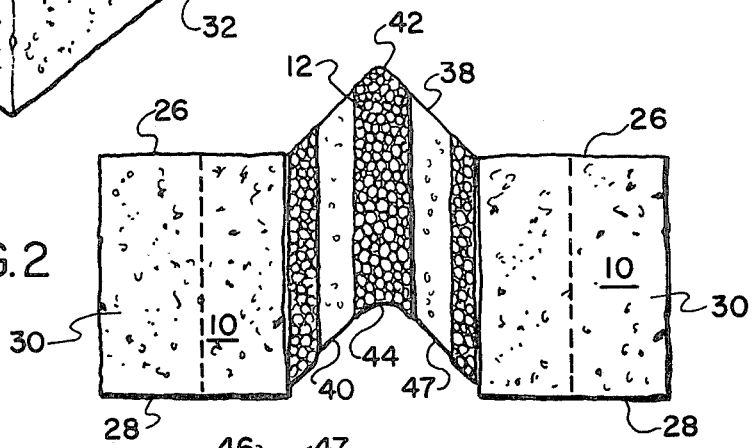
FIG.2
FIG.3
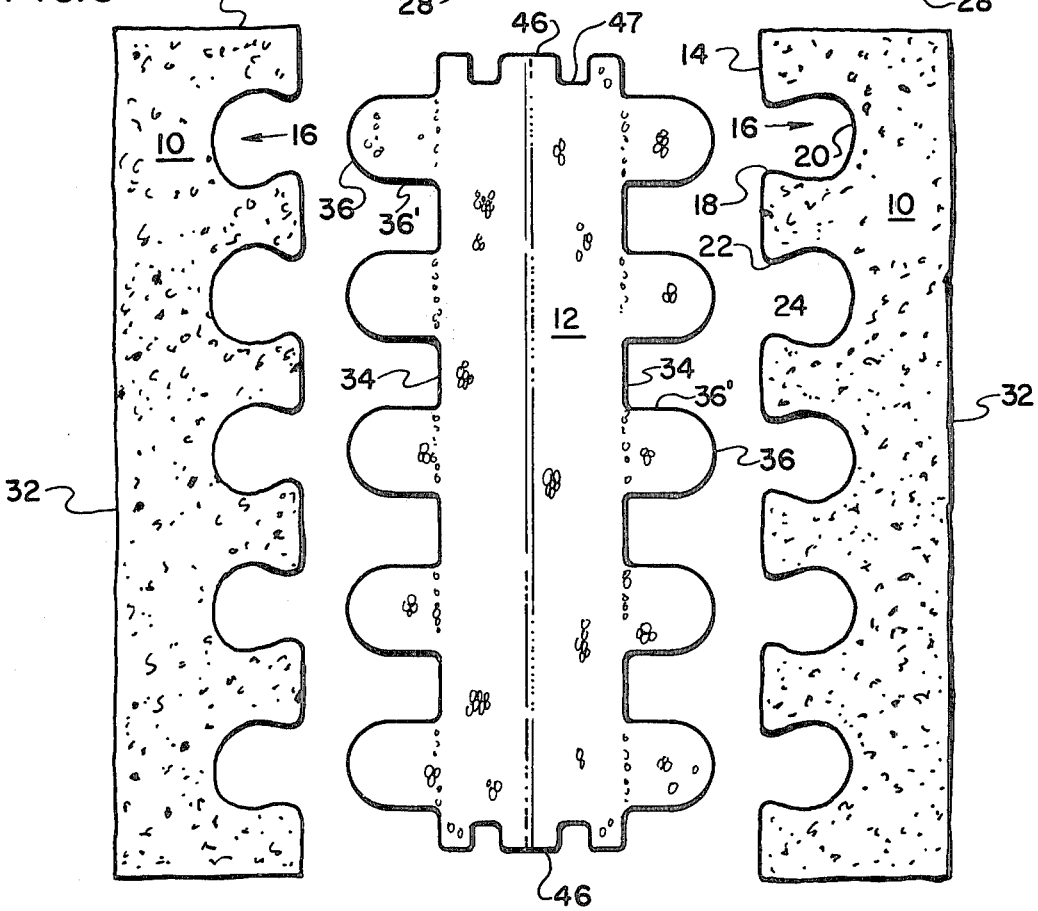

FIG. 4
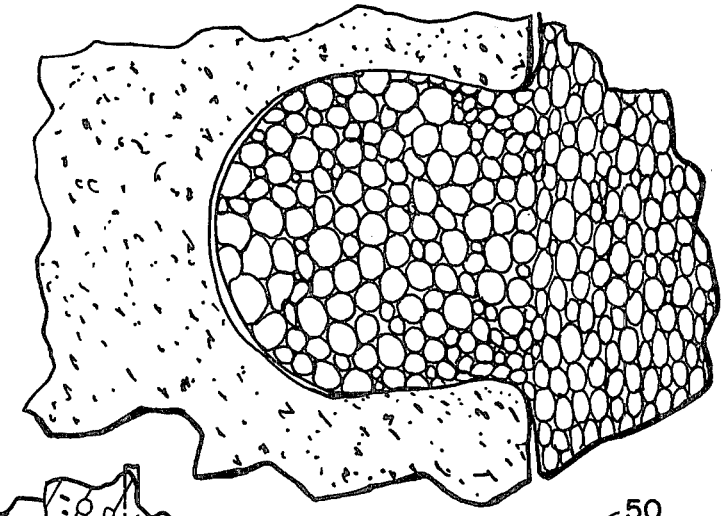
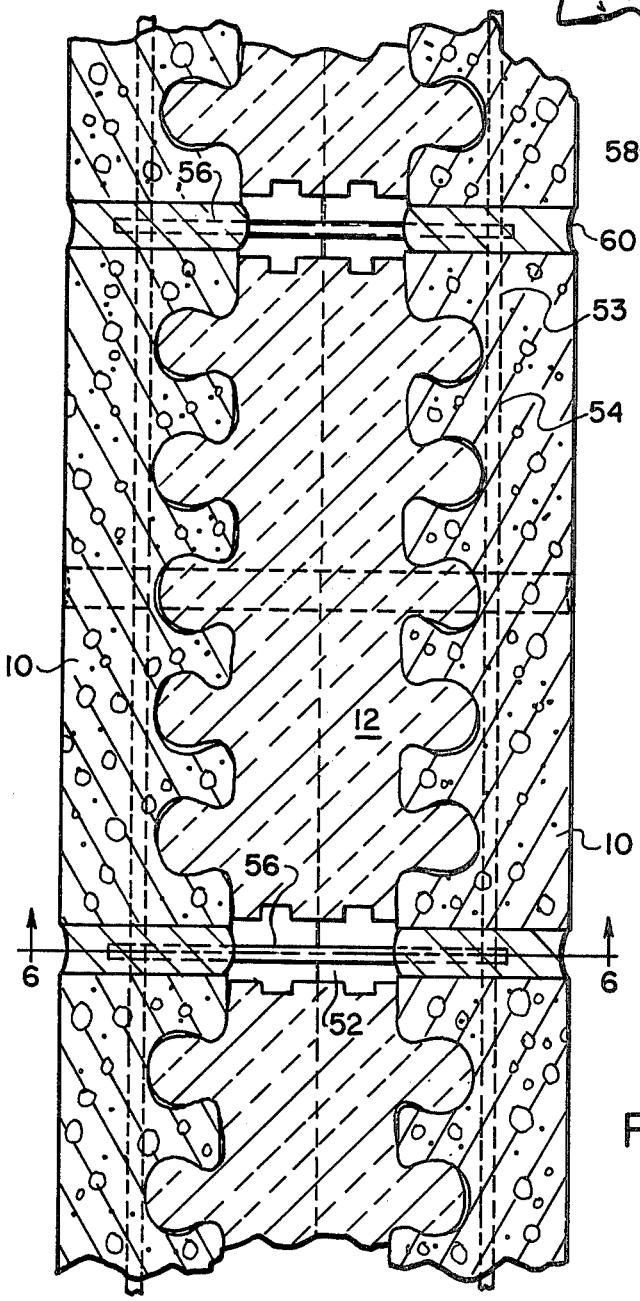
FIG. 5
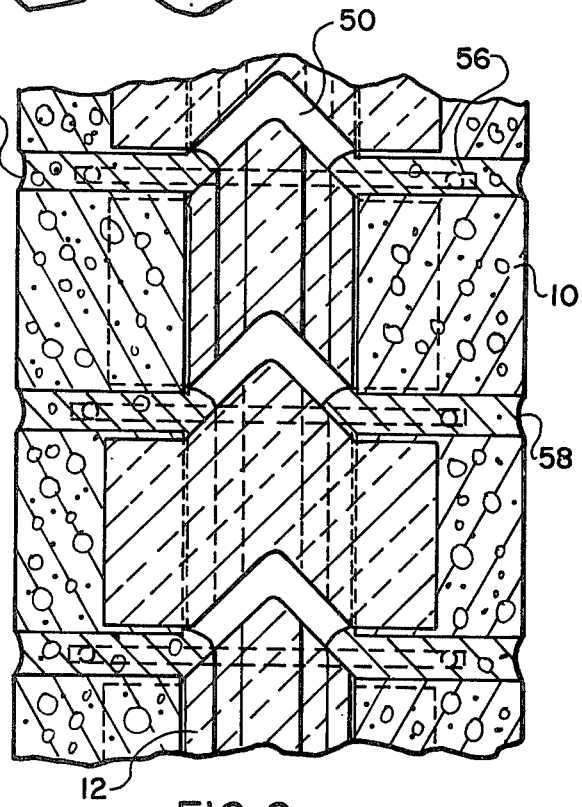
FIG. 6

COMPOSITE BUILDING UNIT, METHOD OF PRODUCING SAME

BACKGROUND OF THE INVENTION

In recent years, the rising cost of building materials and labor, in addition to the rising cost of energy and the resulting increased concern for energy efficiency, have prompted building designers to seek building materials which will provide greater energy efficiency at a lower construction cost than with conventional materials. With respect to materials used for constructing the exterior walls of residences and other buildings, a number of factors must be considered in evaluating the feasibility and usefulness of any proposed material, including structural integrity, weather resistance, insulation capabilities, sound transmission resistance, fire-proofing capabilities, ease and speed of construction, space requirements, ease of maintenance, and aesthetic appeal.

One of the oldest, most widely used and popular materials for constructing exterior walls is brick, a principal advantage of brick being the wide range of aesthetically pleasing colors and finishes which may be obtained using brick. In conventional exterior brick wall construction, a single layer or single "wythe" of brick is constructed by joining individual brick units with mortar with such single wythe wall having a thickness corresponding to the thickness of the individual brick units, a second backup interior wythe of brick or other suitable materials is constructed in close parallel relation thereto, and insulating material is placed between the two wythes. From a cost efficiency standpoint, this conventional operation is considerably more expensive than merely constructing a wall consisting of a single wythe of brick in that it is more time consuming and requires more labor and material. However, a single wythe wall of brick is not normally used without some form of backup wall because such a wall is inherently difficult to waterproof due to cracking of the mortar joints, because it has very little insulating value, and because the exterior surfaces of conventional brick are not normally aesthetically suitable for use both as an interior and exterior wall surface.

The aforesaid waterproofing problem associated with mortar joint brick walls is aggrevated by the inherent tendency of mortar joints to develop cracks, occuring as the result of a number of different factors. Thermal stresses caused both by daily and seasonal atmospheric temperature variations affecting the exterior wall surface and by temperature variations between the interior, room temperature and the exterior atmospheric temperature cause constant expansional and contractional movement in the wall. Building settlement, as well as a variety of other externally imposed forces, place additional stresses on the wall. All of these forces cause the conventional brick wall to shift or "squirm" slightly thereby causing hairline cracks in the mortar joints thereof. Typically, any such hairline crack will extend completely through the brick wall thereby providing a direct flow path for water and air entering the crack.

In contrast, the present invention provides a composite building unit usable in mortar joint wall construction in the same manner as conventional brick, a single wythe of which composite building unit will produce, at a cost significantly reduced in relation to the cost of comparable construction using conventional building materials, a well insulated, energy efficient, aesthetically appealing wall as structurally sound as conventional brick while providing improved waterproof characteristics as compared with a single wythe of conventional brick or other solid masory wall.

SUMMARY OF THE INVENTION

The present invention provides a composite building unit comprising a pair of spaced brick-like elements and an intermediate element formed of compressibly resilient insulating material disposed between the spaced brick-like elements. Each brick-like element has a facing side with a plurality of inwardly extending recesses therein, each recess having a constriction adjacent the facing side from which it extends and an enlarged portion spaced inwardly from the constriction. The brick-like elements are spaced with the facing sides thereof in opposed facing relationship. The intermediate element has two opposed side faces with a plurality of projections extending outwardly from each side face, the intermediate element and the spaced brick-like elements being joined by a press fit with the projections of the intermediate element received within the recesses of the spaced brick-like elements and with the facing sides of the brick-like elements and the side faces of the intermediate element being adjacent to one another. The projections of the intermediate element are relatively compressed at the portions thereof adjacent the recess constrictions and are relatively expanded at the portions thereof located within the enlarged recess portions, the spaced brick-like elements and the intermediate elements being held together by frictional interaction between the projections and the recesses.

According to the preferred embodiment, the projections of the intermediate element are formed with an uniform uncompressed thickness, the uncompressed thickness of the projections being greater than the minimum corresponding dimension of the recess constriction. Each recess includes a pair of spaced inlet wall portions forming continuous curved surfaces extending inwardly from the facing side of the brick-like element to the recess constriction to permit the thicker projections to pass smoothly into the recesses.

It is also preferred that the brick-like elements be formed of vitreous clay with the intermediate element being formed of expanded polystyrene. Alternatively, each element of the pair of brick-like elements may be formed of a different material so that the wall constructed therefrom has a different interior and exterior surface appearance.

In the preferred embodiment, the intermediate element has a top and a bottom face extending transversely between the side faces, the top face having a raised barrier portion extending along the length thereof with a height extending above the brick-like elements and the bottom face having an indentation extending along the length thereof to receive the raised barrier portion of another composite unit when a plurality of the units are stacked in mortar joint wall construction. The raised barrier portion and the indentation are preferably formed with an inverted V-shape. Since this barrier portion is disposed adjacent the mortar joints between the bricks, any water or moisture passing through cracks or the like in the mortar will encounter the barrier and be prevented from passing through the wall to the interior thereof. Any water which passes through the mortar joints to the barrier portion is drained away by virtue of vertical grooves formed in the end faces of the intermediate elements.

The present invention also provides a method for producing a composite building unit of the type described above, such method comprising the following steps. Brick-like material is formed into two brick-like elements of the type described above and compressibly resilient insulating material is formed into an intermediate element of the above-described type. The brick-like elements are arranged in spaced mirror-image relationship with the facing sides thereof in facing relationship and the intermediate element is positioned intermediately thereof with the side faces of the intermediate element facing the facing sides of the brick-like elements and with the projections adjacent the recesses. The brick-like elements are then moved toward the intermediate element to force the projections through the constrictions of the recesses, thereby causing the projections to be received in the recesses with the portions of the projections adjacent the constrictions being compressed and the remaining portion of the projections being expanded in the recess, and causing the side faces of the intermediate element to be located adjacent the facing sides of the brick-like elements.

Finally, the present invention includes a new and novel method of constructing a mortar-joint wall comprising the following steps. A plurality of composite building units are formed, each unit being of the type described above having two spaced brick-like elements and an intermediate insulating element sandwiched therebetween. Each brick-like element is formed with an upper and lower stacking surface and with end surfaces extending between the upper and lower stacking surfaces. The intermediate elements are each formed with a top and a bottom face, the top face having a raised barrier portion extending along the length thereof with a height extending above the adjacent upper stacking surfaces of the brick-like elements and the bottom face having an indentation extending along the length thereof and being shaped to receive the raised barrier portion of another composite unit. The plurality of composite units are then connected with mortar by applying mortar to each upper and lower stacking surface and to each end surface of each brick-like element and arranging the units horizontally in linear end-to-end relationship and stacking said units vertically with at least some of the raised barrier portions of the intermediate elements being received within the indentation of another intermediate element and with the intermediate elements of each unit being spaced from the corresponding intermediate elements of vertically adjacent units, whereby mortar joint bonds are formed between the plurality of composite units. Additionally, if desired, reinforcing rods may be arranged in the mortar joint bonds formed during the connecting of the units to reinforce the bonds.

BRIEF DESCRIPTION OF THE DRAWINGS

FIG. 1 is a perspective view of a composite building unit according to the preferred embodiments of the present invention.

FIG. 2 is an end elevational view of the composite building unit illustrated in FIG. 1.

FIG. 3 is an exploded plan view of the composite building unit illustrated in FIG. 1.

FIG. 4 is a detailed plan view of a portion of the composite building unit illustrated in FIG. 1 showing one intermediate element projection received within one brick-like element recess.

FIG. 5 is a horizontal sectional view of a mortar joint wall constructed with a plurality of the composite building units of the type illustrated in FIG. 1.

FIG. 6 is a vertical sectional view of the wall illustrated in FIG. 5, taken along line 6—6.

DESCRIPTION OF THE PREFERRED EMBODIMENT

Referring now in greater detail to the accompanying drawings, FIG. 1 illustrates an assembled composite building unit formed according to the preferred embodiments of the present invention which includes a pair of elements 10 formed of brick-like material, preferably vitreous clay, spaced in opposed facing relationship and sandwiched about an intermediate element 12 formed of a compressibly resilient insulating material, preferably expanded polystyrene. Each brick-like element 10 is generally in the shape of a rectangular block, having a facing side 14 (FIG. 3) with a plurality of recesses 16 formed therein. Each of the recesses 16 has a constriction 18 adjacent the facing side 14 from which it extends, and an enlarged portion 20 spaced inwardly therefrom within the brick-like element 10. Each recess 16 is formed by a pair of spaced inlet wall portions 22 consisting of two continuous curved surfaces extending inwardly from the facing side 14 of the brick-like element 10 to each respective side of the recess constriction 18, and an interior wall portion 24 joining the pair of inlet wall portions 22, extending therefrom inwardly within the brick-like element 10 as a continuous curved surface to form the enlarged portion 20 of the recess 16. Each brick-like element 10 additionally includes an upper stacking surface 26 and a lower stacking surface 28 to facilitate vertical stacking of the composite units to form a mortar joint wall as will be described presently. Additionally, an end surface 30 of the brick-like elements 10 extends between the upper and lower stacking surfaces 26 and 28, respectively, at each end thereof, and an exterior surface 32 extends between the sides of the upper and lower stacking surface 26 and 28, respectively, spaced from the facing side 14.

The intermediate element 12 is formed with two opposed side faces 34, each having a plurality of projections 36 extending outwardly therefrom equal to the number of recesses 16 formed in the facing sides 14 of the brick-like elements 10. A top face 38 and a bottom face 40 extend transversely between the side faces 34. The top face 38 is provided with a raised barrier portion 42 having an inverted-V shape extending along the length thereof with a height extending above the adjacent upper stacking surfaces 26 of the two brick-like elements 10 when the intermediate element 12 is fitted therebetween. The bottom face 40 is provided with an indentation 44, also having an inverted-V shape, extending along the length thereof. The intermediate element 12 is also provided with opposed end faces 46 extending transversely between the side faces 14 and the top and bottom faces 38 and 40, respectively, at the ends thereof. Each end face 46 is provided with vertical grooves 47 formed therein, each groove 47 extending along the full height of the end face 46. The intermediate element 12 is additionally formed with a length shorter than the length of the brick-like elements 10 so that a vertical cavity is formed at each end of the assembled composite building unit.

In producing a plurality of the above-described composite building unit, it is preferred that the component parts of the unit be produced separately in quantity and shipped separately to the construction site, to be assembled there. The assembling of the composite unit at the location of construction prevents any possible damage to the intermediate insulating elements 12 which could occur if the units were shipped fully assembled.

To form the composite unit from the component parts described above, two of the brick-like elements 10 are arranged in spaced mirror-image relationship with the sides 14 thereof in facing relationship, and an intermediate element 12 is positioned between the spaced brick-like elements 10 with the side faces 34 thereof facing the facing sides 14 of the brick-like elements 10 and with the projections 36 thereof adjacent the recesses 16 of the brick-like elements 10, as illustrated in FIG. 3. As noted above, the projections 36 have a uniform uncompressed thickness that is greater than the width of the recess constriction 18 in the brick-like elements 10. Pressure is then applied laterally to the exterior surfaces 32 of the brick-like elements 10, manually or preferably using a conveyor or other type press, to move the brick-like elements 10 inwardly toward the intermediate element 12 and force the thicker projections 36 of the intermediate element 12 through the constrictions 18 of the brick-like element recesses 16, the smoothly curved surfaces formed by the pair of spaced inlet wall portions 22 permitting the thicker projections 36 to pass smoothly through the recess constriction 18 and into the recess 16. The application of pressure is continued until the projections 36 are fully received in the recesses 16 with the portions of the projections 36 that are adjacent the recess constrictions 18 being compressed thereby, with the remaining portion of the projections 36 being relatively expanded within the enlarged portion 20 of the recess 16, and with the side faces 34 of the intermediate element 12 adjacent to the facing sides 14 of the brick-like elements 10. In this manner, the brick-like elements 10 and the intermediate elements 12 are joined by a press fit and held together by the frictional interaction between the projections 36 and the recesses 16. To obtain maximum advantage from the frictional interaction between the projections 36 and the recesses 16 for holding the brick-like elements 10 and the intermediate elements 12 together, it is desirable that the projections 36 be compressed and frictionally held by the recess constrictions 18 and also that the portions of the projections 36 extending inwardly within the recesses 16 from the constrictions 18 be relatively expanded so as to frictionally engage the interior wall portion 24 of the enlarged portions 20 of the recesses 16. It is therefore preferred that the intermediate element 12 be formed of a somewhat compressibly resilient insulating material such as expanded polystyrene which will permit the thicker projections 36 to be compressed by the recess constrictions 18 as they pass therethrough and to expand slightly after passing therethrough to return to approximately their original thickness thereby allowing frictional interaction of the projections with the enlarged recess portions 20 as well as the constrictions 18. The formation of the recess inlet surfaces 22 as smooth, continuous curved surfaces assists in obtaining this result because the compressive force thereby imparted against the sides 36' of the projections 36 is relatively gentle.

Additionally, it should be noted that when the components of the composite unit of the present invention are joined by the above-described process, the application of pressure is continued, as noted above, until the projections 36 are fully received within the recesses 16 but is not always continued sufficiently long enough to bring the side faces 34 of the intermediate element 12 into abutment with the facing sides 14 of the two brick-like elements 10, as can best be seen in FIG. 1. This is because the relatively small degree of control over the dimensional tolerances involved in the working and shaping of brick-like materials and of insulating materials such as expanded polystyrene makes it impractical to form the brick-like elements 10 and the intermediate elements 12 with a constant, uniform size. Therefore, in order to insure that the finished composite building units of the present invention are of relatively uniform width, the application of pressure to join the components is continued until the projections 36 are fully received in the recesses 16 and thereafter sufficiently long enough to bring the completed unit to the desired final dimension.

The present invention additionally makes available a new and novel method of constructing a mortar joint wall utilizing the composite building units described above. As noted above, each brick-like element 10 is provided with an upper and lower stacking surface 27 and 28, respectively, and each intermediate element indentation 44 is shaped to receive the raised barrier portion 42 of the intermediate element 12 of another composite unit. Thus, the composite units of the present invention may be readily stacked vertically in mortar joint wall construction. In constructing a mortar joint wall with the composite units of the present invention, mortar is applied to each upper and lower stacking surface 26 and 28, respectively, and to each end surface 30 of the brick-like elements 10 of each composite unit and the units are arranged horizontally end-to-end and vertically stacked (see FIGS. 5 and 6) with the raised barrier portion 42 of each intermediate element 12 being received within the indentation 44 of another intermediate element 12 (excepting the intermediate elements 12 of those units in the uppermost horizontal row) thereby forming mortar joint bonds 58 between the facing upper and lower stacking surfaces 26 and 28, respectively, of vertically adjacent units and forming mortar joint bonds 60 between the facing end surfaces 30 of horizontally adjacent units.

Since mortar is not applied to any surface of the intermediate elements 12, the intermediate elements 12 of the plurality of units are each spaced vertically and horizontally from the intermediate elements of adjacent units in the wall, thereby forming small air spaces 50 between each raised barrier portion 42 and the indentation 44 within which it is received, and also forming air spaces 52 between the end faces of horizontally adjacent units. It is preferred that in arranging the composite units horizontally and vertically, as aformentioned, the units of each horizontal row of units be staggered in conventional manner so as to overlap the mortar joints between the end surfaces 30 of the units of the horizontal row immediately therebelow. In this manner, convection heat flow caused by direct vertical passage of air between the several horizontal rows of units in the finished wall is prevented since no direct vertical air passage exists. In effect the air spaces 50 and 52 are stagnant and therefore perform an insulating function, the insulating effect of the air spaces 50 and 52 in conjunction with the insulating effect of the intermediate elements 12 being comparable to that of a continuously insulated conventional wall.

A single wythe wall produced according to the abovedescribed method is significantly more resistant to structural cracks and water leakage than is a single wythe of any conventional brick. In a wall produced as described above, separate mortar joint bonds 58 and 60 are formed between the brick-like elements 10 of the interior wall surface and between the brick-like elements of the exterior wall surface with the interior and exterior surfaces being insulated from each other by the intermediate elements 12 and the air spaces 50 and 52. Thus, the effect of temperature variations between the internal room temperature and the external ambient temperature on the mortar joint bonds 58 and 60 between the brick-like elements 10 of either the interior or exterior wall surface is reduced. Additionally, the brick-like elements 10 forming the interior and exterior wall surfaces are permitted to expand and contract independently so that stresses causing cracks in the mortar joints 58 and 60 of either the interior or exterior wall surfaces do not normally affect the mortar joints of the other wall surface. In this manner, the likelihood and the number of structural cracks in the mortar joint bonds 58 and 60 of a wall constructed according to the present invention are reduced. Even when structural cracks do form in the mortar joint bonds 58 and 60 in either or both of the interior and exterior wall surfaces, the raised barrier portion 42 of the intermediate element 12 acts as a dam so that any water that does enter cracks in the mortar joints 58 and 60 between the brick-like elements 10 is prevented from passing through the wall and is instead channeled horizontally through air spaces 50 to the ends of the composite unit where the water falls downwardly to the next successively lower course of brick through the grooves 47 and the air space 52, the water being drained within the wall to each successively lower course of masonry until it either evaporates or is weeped away to the outside of the wall. In this regard it is to be noted that although it is preferred that both the raised barrier portion 42 and the indentation 44 be formed with an inverted-V shape, it is to be understood that the barrier portion 42 may be formed of any other shape without departing from the intent and scope of the present invention and that the indentation 44 may also be formed of any other shape so long as it is capable of receiving the raised barrier portion 42 of another composite building unit when a plurality of the composite units are stacked in mortar joint wall construction.

Since the brick-like elements 10 forming the interior wall surface are insulated and separated from the brick-like elements 10 forming the exterior wall surface by the intermediate element 12, the two brick-like elements 10 of each unit may be formed of different materials, the brick-like elements 10 appearing on the exterior wall surface being formed of a suitable brick-like material which is weather resistant and the brick-like elements 10 appearing on the interior wall surface being formed of a material aesthetically suitable for such use. Such variation in the interior and exterior surface appearance of a mortar joint wall is not possible when using conventional brick without constructing at least two wythe which necessarily would increase costs. Therefore, since a crack and leak resistant, insulated wall may be produced according to the present invention by the construction of only a single wythe of the composite units described-above, labor and material costs may be significantly reduced below that of comparable conventional construction. Another advantage lies in the fact that a single wythe of the composite units is substantially thinner than a conventional insulated wall, thereby permitting an increase in the interior floor space without a corresponding increase of the exterior dimensions of the structure.

Since mortar and masonry are strongest in compressive strength and weakest in tensile and shear strength, a traditional masonry joint reinforcement 53 composed of steel wires 54 and 56 welded into a ladder-like unit may be placed in the mortar joints 58 and 60 to increase the tensile strength of the wall and thereby reduce the mortar joint stresses during the cooling down period in each thermal change cycle. Wires 54 of the unit extend longitudinally in the mortar joints 58 formed between the facing upper and lower stacking surfaces 26 and 28, respectively, of vertically adjacent composite units. Wires 56 extend transversely of wires 54 in the mortar joints 60 formed between the facing end surfaces 30 of horizontally adjacent units and further act to structurally tie the interior and exterior wall surfaces together, while remaining flexible enough to allow the two wall surfaces to expand and contract independently. Although the steel reinforcements 53 are illustrated in FIG. 6 as occurring between every horizontal course of masonry, it is to be noted, as one skilled in the art will readily understand, that the reinforcements 53 may be employed in alternating rows only, without any substantial degree of loss in the tensile strength of the wall.

Although, the present invention has been described in relation to the preferred embodiments, it is to be understood that modifications and variations may be resorted to without departing from the substance or scope of the present invention as those skilled in the art will readily understand. Such modifications and variations are within the scope of the present invention, which is intended to be limited only by the appended claims and equivalents thereof.

I claim:

1. A composite building unit for mortar joint wall construction comprising:

(a) a pair of elements formed of brick-like material, each said element having a facing side with a plurality of inwardly extending recesses therein, each said recess having a constriction adjacent the facing side from which it extends and an enlarged portion spaced inwardly from said constriction said pair of brick-like elements being spaced with the facing sides thereof in opposed facing relationship, (b) an intermediate element formed of compressibly resilient insulating material disposed between said pair of spaced brick-like elements and having two opposed side faces with a plurality of projections extending outwardly from each said side face, said intermediate element and said spaced brick-like elements being joined by a press fit with said projections of said intermediate element received within said recesses of said spaced brick-like elements and with said facing sides of said spaced brick-like elements and said side faces of said intermediate element being adjacent to one another, said projections being relatively compressed at the portions thereof adjacent said recess constrictions and being relatively expanded at the portions thereof located within said enlarged recess portions, said spaced brick-like elements and said intermediate elements being held together by frictional interaction between said projections and said recesses.

2. A composite building unit according to claim 1 and characterized further in that said spaced brick-like elements are formed of vitreous clay and said intermediate element is formed of expanded polystyrene.

3. A composite building unit according to claim 1 and characterized further in that said projections are formed with a uniform uncompressed thickness, the uncompressed thickness of said projections being greater than the minimum corresponding dimension of said recess constriction.

4. A composite building unit according to claim 3 and characterized further in that each said brick-like element recess includes a pair of spaced inlet wall portions forming two continuous curved surfaces extending inwardly from said facing side of said brick-like element to said recess constriction to permit said thicker projections to pass smoothly into said recess.

5. A composite building unit according to claim 4 and characterized further in that each said brick-like element recess includes an interior wall portion joining said pair of inlet wall portions and extending therefrom as a continuous curved surface to form said enlarged portion of said recess.

6. A composite building unit according to claim 1 and characterized further in that each element of said pair of brick-like elements is formed of a different material.

7. A composite building unit according to claim 1 and characterized further in that said intermediate element has a top and a bottom face extending transversely between said side faces, said top face having a raised barrier portion extending along the length thereof with a height extending above said brick-like elements, and said bottom face having an indentation extending along the length thereof and being shaped to receive the raised barrier portion of another composite building unit when a plurality of said composite building units are stacked in a mortar joint wall construction.

8. A composite building unit according to claim 7 and characterized further in that said raised barrier portion and said indentation are of an inverted-V shape.

9. A composite building unit according to claim 7 and characterized further in that said intermediate element has opposed end faces extending transversely between said side faces and said top and bottom faces at the ends thereof, each said end face having vertical grooves formed therein to facilitate liquid drainage therethrough.

10. A composite building unit according to claim 9 and characterized further in that said intermediate element is of a shorter length than said brick-like elements such that a vertical cavity is formed at each end of said composite building unit.

11. A method of producing a composite building unit for mortar joint wall construction comprising the steps of:

(a) forming brick-like material into two elements each with a plurality of recesses extending inwardly from a facing side thereof, each said recess having a constriction adjacent the facing side from which it extends and an enlarged portion spaced inwardly from said constriction, (b) forming compressibly resilient insulating material into an intermediate element having a plurality of projections of a uniform thickness greater than the width of said constrictions extending outwardly from each of two opposed side faces thereof, (c) arranging said brick-like elements in spaced mirror-image relationship with the facing sides thereof in facing relationship, and positioning said intermediate element intermediately of said spaced brick-like elements with the side faces of said intermediate element facing said facing sides of said brick-like elements and with said projections adjacent said recesses, and (d) moving each said brick-like element toward said intermediate element to force said projections through the constrictions of said recesses, thereby causing said projections to be received in said recesses with the portions of said projections adjacent said constrictions being compressed and the remaining portion of said projections being expanded in said recesses, and causing the side faces of said intermedite element to be disposed adjacent to the facing sides of said brick-like elements.

12. A method of producing a composite building unit according to claim 11 and characterized further by forming said brick-like elements from vitreous clay and by forming said intermediate element from expanded polystyrene.

13. A method of producing a composite building unit according to claim 11 and characterized further by forming said two brick-like elements of different materials.

* * * * *